US010235986B1

(12) United States Patent
Dupuy

(10) Patent No.: US 10,235,986 B1
(45) Date of Patent: Mar. 19, 2019

(54) ACOUSTIC SYSTEM FOR CANCELLING OUT-OF-PHASE REFLECTED SOUNDWAVES OF AUDIO OUTPUT SYSTEMS

(71) Applicant: Rudolph Dupuy, Tappan, NY (US)

(72) Inventor: Rudolph Dupuy, Tappan, NY (US)

( * ) Notice: Subject to any disclaimer, the term of this patent is extended or adjusted under 35 U.S.C. 154(b) by 0 days.

(21) Appl. No.: 16/055,760

(22) Filed: Aug. 6, 2018

(51) Int. Cl.
*G10K 11/178* (2006.01)
*H04R 5/02* (2006.01)
*H04R 1/34* (2006.01)

(52) U.S. Cl.
CPC ..... *G10K 11/178* (2013.01); *H04R 5/02* (2013.01); *G10K 2210/12* (2013.01); *H04R 1/347* (2013.01)

(58) Field of Classification Search
None
See application file for complete search history.

(56) References Cited

U.S. PATENT DOCUMENTS 5,910,192 A * 6/1999 Pulford, Jr. ..... G05G 11/00 403/225
9,845,598 B1 * 12/2017 Hsu ..... E04F 13/0862
2004/0190746 A1 * 9/2004 Seki ..... H04R 5/02 381/388
2006/0222191 A1 * 10/2006 Hung ..... H04R 5/02 381/307
2008/0289899 A1 * 11/2008 Kliegle ..... E04B 1/8236 181/210
2009/0175469 A1 * 7/2009 Kondo ..... H04R 7/045 381/152
2010/0198426 A1 * 8/2010 Kondo ..... G10K 11/28 700/302
2017/0105070 A1 * 4/2017 O'Polka ..... H04R 5/02

* cited by examiner

*Primary Examiner* — Paul W Huber
(74) *Attorney, Agent, or Firm* — Dunlap Bennett & Ludwig PLLC

(57) ABSTRACT

An acoustic system for cancelling out-of-phase reflected soundwaves of an audio output system is provided. The acoustic system provides an acoustic element operatively associated with a positioning system adapted to selectively and bidirectionally position the acoustic element relative to an acoustic center arc of the audio output system so as to be disposed at or nearest a deepest reflector point of the acoustic center arc, cancelling out-of-phase reflected soundwaves from a wall adjacent to the audio output system.

6 Claims, 3 Drawing Sheets

ACOUSTIC SYSTEM FOR CANCELLING OUT-OF-PHASE REFLECTED SOUNDWAVES OF AUDIO OUTPUT SYSTEMS

BACKGROUND OF THE INVENTION

The present invention relates to acoustics and, more particularly, to an acoustic system for cancelling out-of-phase reflected soundwaves of audio output systems.

Phase is the position at a point in time (an instant) on a waveform cycle, for example a soundwave. A cycle is defined as the interval required for the waveform to return to its arbitrary initial value. Phase can also be an expression of relative displacement between two corresponding features (for example, peaks or zero crossings) of two waveforms having the same frequency, where the waveforms are identical and originated at identical positions (i.e., the same waveform) but where one of the waveforms is a reflection (off, say, a reflective surface) of the other.

The wall behind speakers tends to act as such a reflective surface, reflecting the original "direct" (zero delay) soundwave being outputted from the speakers so that when the reflected soundwaves reach the listener they are out of phase relative to the original "direct" outputted soundwaves. This dissonance results in inferior overall acoustics of the acoustic space and sound quality of the output.

Current sound quality solutions include acoustical devices such as diffusers or absorbers, but they do not address the out of phase reflections problems; rather their purposes are limited to diffusion and absorption of unwanted soundwaves, respectively.

As can be seen, there is a need for an acoustic system for selectively cancelling out-of-phase reflected soundwaves of audio output systems. The acoustic system being adapted to partially cancel the out of phase reflections from reflective surfaces adjacent to the audio output source. The present invention does not absorb or diffuse such back-wave reflections, rather it makes corrections to the back-wave reflections. When adjustably aligned with the acoustic center of the audio output devices (speakers) and partially covering the reflective surface adjacent to the audio output devices, the system embodied in the present invention cancels the out of phase reflections leaving the in-phase reflections that synchronize with the direct soundwaves, engendering a major improvement in stereo sound reproduction.

SUMMARY OF THE INVENTION

In one aspect of the present invention, a selectively adjustable acoustic element includes an acoustic element operatively associated with a track of a positioning system; and the positioning system configured to move the acoustic element between a furthest position and a closest position along a longitudinal axis of the track.

In another aspect of the present invention, the selectively adjustable acoustic element includes an acoustic element made of acoustic material forming a compound curved surface extend between an upper end and a lower end; a base providing a track; a track guide protruding from the lower end, the track guide dimensioned to slidably engage said track; and the track guide providing a crank shaft journaled therethrough so that when the crank shaft rotates the acoustic element moves between a furthest position and a closest position along a longitudinal axis of said track.

In yet another aspect of the present invention, an acoustic system for cancelling out-of-phase reflected soundwaves of an audio output system positioned adjacent a reflective vertical surface includes the sound system providing two spaced apart audio output devices so as to define an acoustic center arc; and the above mentioned selectively adjustable acoustic element disposed so that the acoustic element moved between the furthest and closest positions so that the concave curvilinear surface is positioned at or near a deepest reflector point of the acoustic center arc, and wherein the compound curved surface faces a listener.

In yet another aspect of the present invention, a method of cancelling out-of-phase reflected soundwaves of two audio output devices positioned adjacent a reflective vertical surface, includes the steps of defining an acoustic center arc by spacing apart the two audio output devices; placing the above mentioned selectively adjustable acoustic element midpoint the two spaced apart audio output devices; and moving the acoustic element via the positioning system between the furthest and closest positions so that the compound curved surface is positioned to align with the acoustic center arc.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

Broadly, an embodiment of the present invention provides an acoustic system for selectively cancelling out-of-phase reflected soundwaves of an audio output system. The acoustic system provides an acoustic element operatively associated with a positioning system adapted to selectively and bidirectionally position the acoustic element relative to an acoustic center arc of the audio output system so as to be disposed at or nearest a deepest reflector point of the acoustic center arc so as to cancel out-of-phase reflected soundwaves from a wall adjacent to the audio output system.

Referring to FIGS. 1 through 5, the present invention may include an acoustic element 10 operatively associated with a positioning system 50 adapted to selectively adjust of a directional position of the acoustic element 10.

Figure 1:
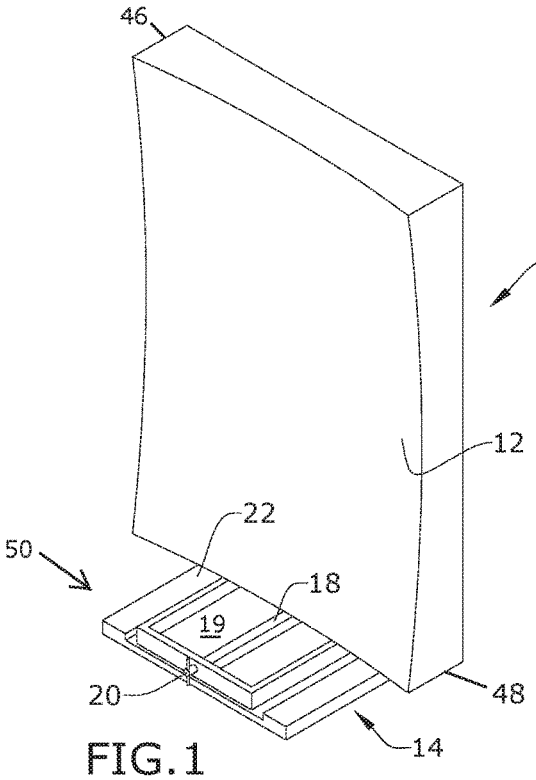
FIG. 1 is a perspective view of an exemplary embodiment of the present invention, illustrating a furthest position.
Figure 2:
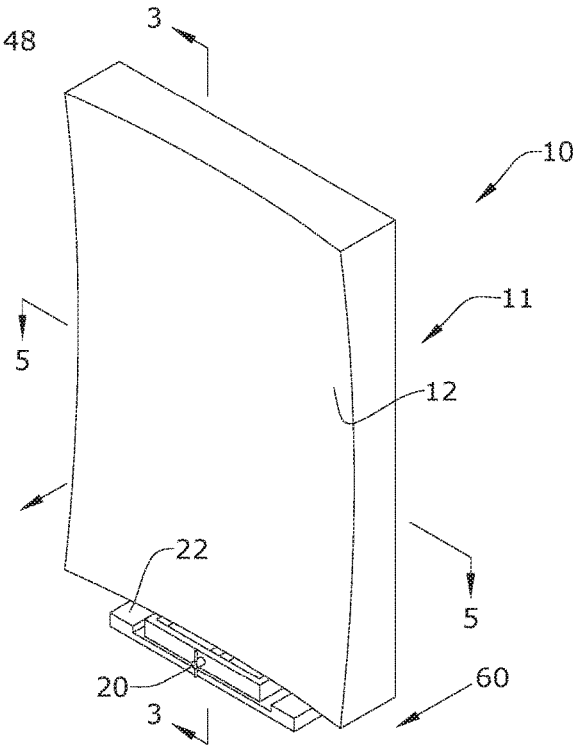
FIG. 2 is a perspective view of an exemplary embodiment of the present invention, illustrating movement in a first direction toward a closest position.
Figure 3:
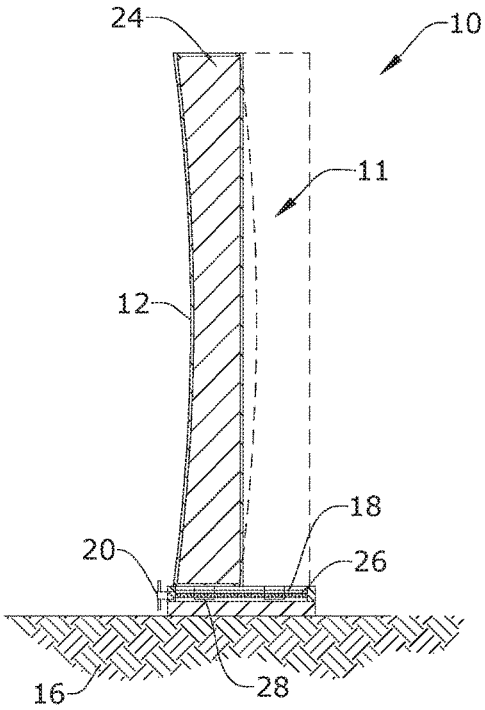
FIG. 3 is a section view of an exemplary embodiment of the present invention, taken along line 3-3 of FIG. 2, illustrating movement in the first direction.

Each acoustic element 10 may include an acoustic body 11 of acoustic material adapted to reflect soundwaves, wherein the acoustic body 11 provides a curvilinear surface 12 having a compound curved outline, as illustrated in FIG. 1. Each acoustic element 10 may extend from an upper end 46 to a lower end 48.

It should be understood by those skilled in the art that the use of directional terms such as upper, lower, and the like are used in relation to the illustrative embodiments as they are depicted in the figures, the upper direction being toward the top of the corresponding figures and a lower (downward) direction being toward the bottom of the corresponding figure.

Figure 4:
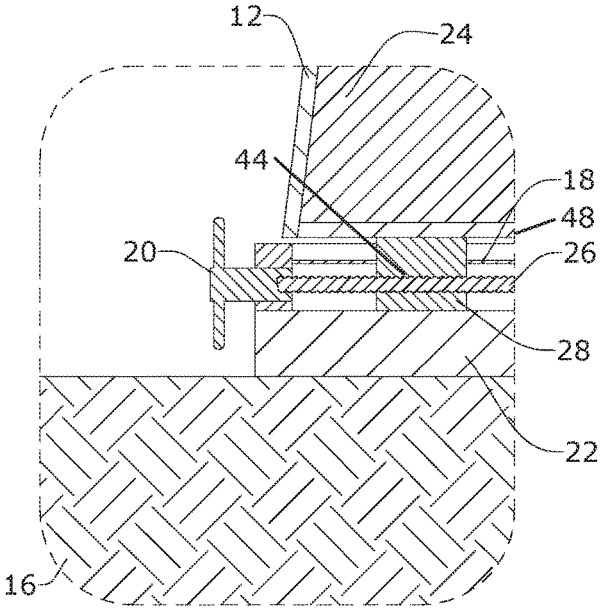
FIG. 4 is a detail section view of an exemplary embodiment of the present invention.
Figure 5:
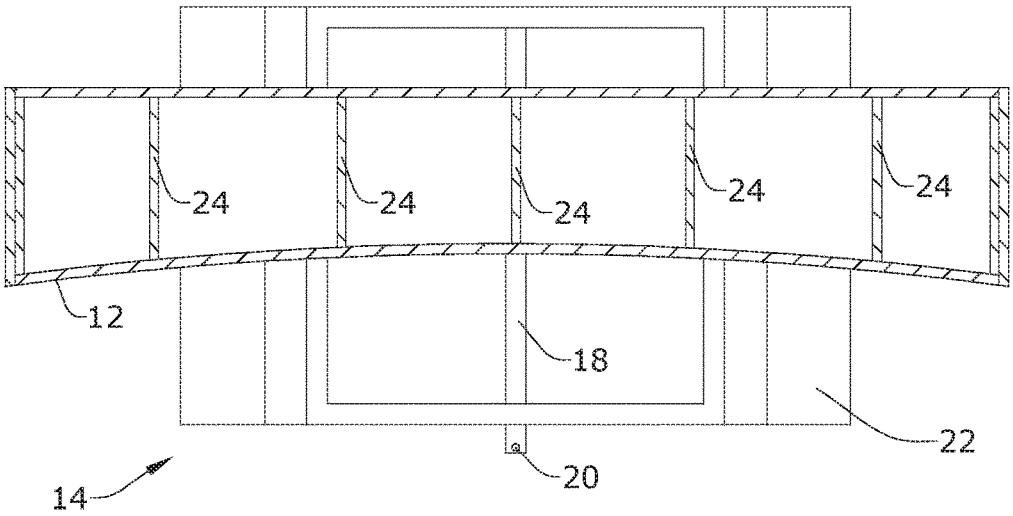
FIG. 5 is a section view of an exemplary embodiment of the present invention, taken along line 5-5 of FIG. 2.

Each acoustic element 10 may provide one or more track guides 28 extending downwardly from the lower end 48. The positioning system 50 may include a base 14 for engaging a supporting surface 16, such as the floor or ground. The base 14 may provide and/or be made of granite slabs 22 or the like for providing a stable and vibrationally resistant base 14. The base 14 may support a track housing 19, the track housing 19 providing one or more tracks 18, each track 18 dimensioned and adapted to slidably receive a track guide 28, as illustrated in FIG. 4. In certain embodiments, each track guide 28 has a peripheral surface dimensioned to at most abut against the inward-facing walls of the track 18.

Each track guide 28 may provide a through hole 44 through which a crank shaft 26 is operatively journaled. The crank shaft 26 and the through hole 44 may complementarily threaded so that when the crank shaft 26 is rotated about its longitudinal axis, the track guide 28 moves along the crank shaft 26 and thus the track 18. Rotation in a clockwise direction causes the track guide 28, and thus the operatively associated acoustic element 10, to move in a first direction 60 along the track 18 relative to the positioning system 10, while rotation in the counterclockwise direction causes the track guide 28 to move in second direction opposite to the first direction 60. The crank shaft 26 may be operatively associated with an arm crank 20 protruding from the track housing 19 for selectively rotating the crank shaft 26, and thus moving the acoustic element 10 between a furthest and a closest position via the second direction and the first direction 60, respectively. In alternative embodiments, a motor (manually or electrically controlled) may be adapted to selectively adjust the position of the acoustic element 10 horizontally relative to a supporting surface 16 in a parallel orientation thereto.

Figure 6:
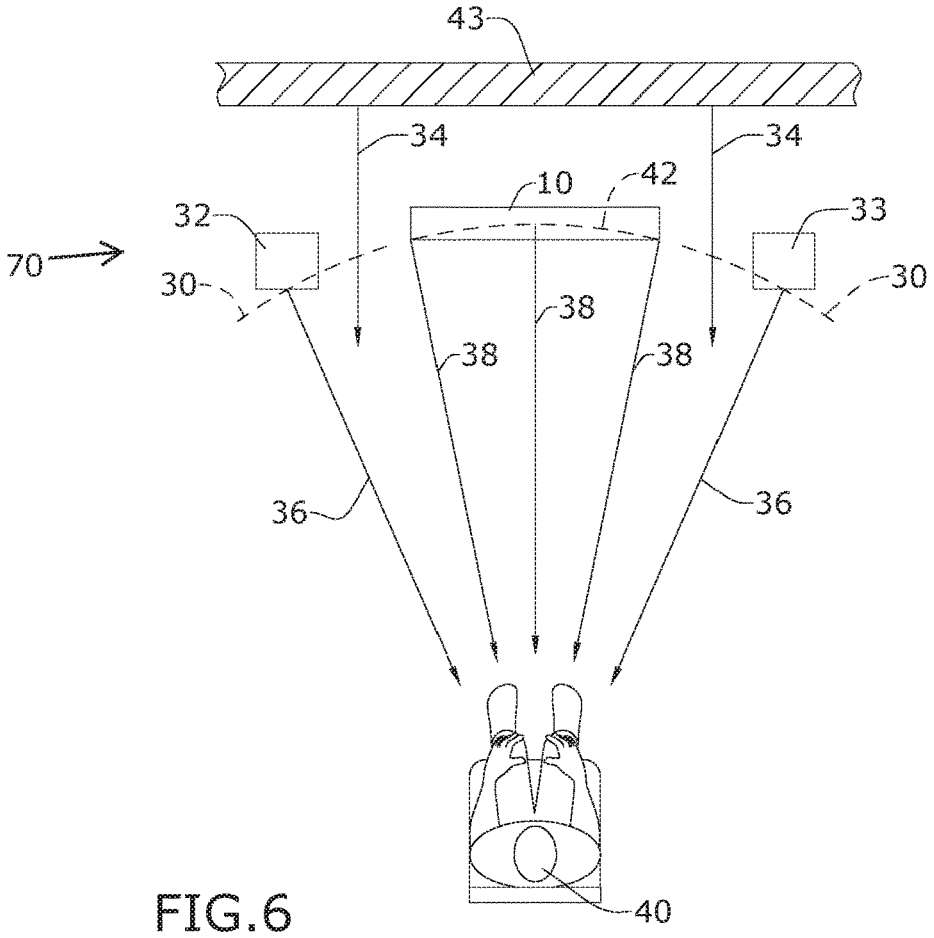
FIG. 6 is a schematic view of an exemplary embodiment of the present invention, showing sound reflection.

Thereby, a user may selectively engage the positioning system 50 to achieve proper alignment and position of the acoustic element 10 in one direction at a constant elevation when configuring a sound system 70 adjacent to a reflective surface 43, as illustrated in FIG. 6. The sound system 70 may include a first and second audio output devices 32 and 33 defining an acoustic center arc 30 along which the acoustic element 10 may be positioned midpoint between the two spaced apart output devices 32 and 33.

A method of using the present invention may include the following. The acoustic element 10 operatively associated with positioning system 50 disclosed above may be provided. A user may selectively adjust the positioning system 50 so that the acoustic element 10 bidirectionally moves parallel relative to the supporting surface 16 (the elevation of the acoustic element 10 being constant) along the acoustic center arc 30 of the sound system 70, to a deepest reflector point 42. As a result, the back wall reflective sound waves 34 reflecting off the reflective surface (wall) 43 are mostly cancelled by the acoustic element 10, which intercepts most would be reflective waves 34, restoring them to reflector waves reflected soundwaves 38 which will be in phase with the direct soundwaves (zero delay in-phase soundwaves) 36. Thereby, the listener 40 perceives a superior sound production from the sound system through mechanical ways of controlling soundwave reflections.

Also, the present invention can be utilized for movie screens, tv screens, integrated one-piece stereo system, recording studios and the like.

It should be understood, of course, that the foregoing relates to exemplary embodiments of the invention and that modifications may be made without departing from the spirit and scope of the invention as set forth in the following claims.

What is claimed is:

1. An acoustic system for cancelling out-of-phase reflected soundwaves of an audio output system positioned adjacent a reflective vertical surface, comprising:
- a sound system providing two spaced apart audio output devices so as to define an acoustic center arc;
- a selectively adjustable acoustic element comprising:
  - an acoustic element operatively associated with a track of a positioning system; and
  - the positioning system configured to move the acoustic element between a furthest position and a closest position along a longitudinal axis of the track; and
- the selectively adjustable acoustic element disposed so that the acoustic element moved between the furthest and closest positions so as to positioned at or near a deepest reflector point of the acoustic center arc.

2. An acoustic system for cancelling out-of-phase reflected soundwaves of an audio output system positioned adjacent a reflective vertical surface, comprising:
- a sound system providing two spaced apart audio output devices so as to define an acoustic center arc;
- a selectively adjustable acoustic element comprising:
  - an acoustic element operatively associated with a track of a positioning system;
  - the acoustic element made of acoustic material forming a compound curved surface extend between an upper end and a lower end; and
  - the positioning system configured to move the acoustic element between a furthest position and a closest position along a longitudinal axis of the track; and
- the selectively adjustable acoustic element disposed so that the acoustic element moved between the furthest and closest positions so that the compound curved surface is positioned at or near a deepest reflector point of the acoustic center arc, and wherein the compound curved surface faces a listener.

3. A method of cancelling out-of-phase reflected soundwaves of two audio output devices positioned adjacent a reflective vertical surface and restoring the phase and time of sound waves comprising the steps of:
- defining an acoustic center arc by spacing apart the two audio output devices;
- providing a selectively adjustable acoustic element comprising:
  - an acoustic element operatively associated with a track of a positioning system;
  - the acoustic element made of acoustic material forming a compound curved surface extend between an upper end and a lower end; and
  - the positioning system configured to move the acoustic element between a furthest position and a closest position along a longitudinal axis of the track;
- placing the selectively adjustable acoustic element midpoint the two spaced apart audio output devices; and
- moving the acoustic element via the positioning system between the furthest and closest positions so that the compound curved surface is positioned at or near a deepest reflector point of the acoustic center arc.

4. The method of claim 3, wherein the acoustic element is positioned at an equal distance between the first speaker and the second speaker.

5. The method of claim 3, wherein the acoustical element is positioned at an ear level of a user.

6. The method of claim 3, wherein the acoustical element is positioned between a user position and a back wall.

* * * * *